US010957508B2

(12) United States Patent
Oh et al.

(10) Patent No.: US 10,957,508 B2
(45) Date of Patent: Mar. 23, 2021

(54) RECYCLABLE FUSE CAPABLE OF REUSE

(71) Applicant: LG CHEM, LTD., Seoul (KR)

(72) Inventors: Kyuhwan Oh, Daejeon (KR); Yeonsoon Choi, Daejeon (KR); Sunwoo Yun, Daejeon (KR); Young Ho Hwang, Daejeon (KR)

(73) Assignee: LG CHEM, LTD., Seoul (KR)

( * ) Notice: Subject to any disclaimer, the term of this patent is extended or adjusted under 35 U.S.C. 154(b) by 208 days.

(21) Appl. No.: 16/307,822

(22) PCT Filed: Dec. 20, 2017

(86) PCT No.: PCT/KR2017/015136

§ 371 (c)(1),
(2) Date: Dec. 6, 2018

(87) PCT Pub. No.: WO2018/124608

PCT Pub. Date: Jul. 5, 2018

(65) Prior Publication Data

US 2019/0214212 A1 Jul. 11, 2019

(30) Foreign Application Priority Data

Dec. 28, 2016 (KR) ..... 10-2016-0181540

(51) Int. Cl.
*H01H 85/04* (2006.01)
*H01H 85/20* (2006.01)
(Continued)

(52) U.S. Cl.
CPC ..... *H01H 85/04* (2013.01); *H01H 37/52* (2013.01); *H01H 37/761* (2013.01);
(Continued)

(58) Field of Classification Search
CPC ..... H01C 1/1406; H01C 7/027; H01C 7/126; H01H 1/20; H01H 11/00; H01H 2037/526;
(Continued)

(56) References Cited

U.S. PATENT DOCUMENTS 3,947,798 A * 3/1976 Zankl ..... H01H 85/00 337/228
4,319,126 A * 3/1982 Lujic ..... H01H 37/002 219/494
(Continued)

FOREIGN PATENT DOCUMENTS

CN 201173191 Y 12/2008
CN 103155086 A 6/2013
(Continued)

OTHER PUBLICATIONS

International Search Report issued in PCT/KR2017/015136 (PCT/ISA/210), dated Mar. 28, 2018.
(Continued)

*Primary Examiner* — Jared Fureman
*Assistant Examiner* — Nicolas Bellido
(74) *Attorney, Agent, or Firm* — Birch, Stewart, Kolasch & Birch, LLP

(57) ABSTRACT

A recyclable fuse includes a first contact and a second contact, and a current control unit allowing current to flow by electrically connecting the first contact and the second contact with each other when a temperature of the current control unit is less than a predetermined first temperature and preventing the current from flowing by electrically interrupting the first contact and the second contact from each other when the temperature of the current control unit is equal to or more than the predetermined first temperature.

8 Claims, 4 Drawing Sheets

(51) Int. Cl.

| | |
|---|---|
| ***H01H 37/76*** | (2006.01) |
| ***H01H 37/52*** | (2006.01) |
| *H01H 85/36* | (2006.01) |
| *H01H 37/00* | (2006.01) |

(52) U.S. Cl.
CPC ..... *H01H 85/20* (2013.01); *H01H 85/205* (2013.01); *H01H 37/002* (2013.01); *H01H 85/36* (2013.01)

(58) Field of Classification Search
CPC ..... H01H 2037/705; H01H 2037/768; H01H 2203/026; H01H 37/002; H01H 37/323; H01H 37/52; H01H 37/54; H01H 37/5409; H01H 37/761; H01H 79/00; H01H 85/04; H01H 85/20; H01H 85/205; H01H 85/36; H01L 23/62; H01M 10/44; H02M 2001/325
See application file for complete search history.

(56) References Cited

U.S. PATENT DOCUMENTS

| | | | | |
|---|---|---|---|---|
| 7,071,809 | B2 | 7/2006 | Davis et al. | |
| 7,209,336 | B2 * | 4/2007 | Yu ..... | H01C 7/126 200/400 |
| 2007/0030110 | A1 * | 2/2007 | Kawanishi ..... | H01H 37/764 337/36 |
| 2014/0253280 | A1 * | 9/2014 | Kim ..... | H01H 37/323 337/139 |

FOREIGN PATENT DOCUMENTS

| | | | |
|---|---|---|---|
| EP | 2 026 359 | A1 | 2/2009 |
| JP | 59-9820 | A | 1/1984 |
| JP | 2002-343134 | A | 11/2002 |
| JP | 2005-302465 | A | 10/2005 |
| JP | 2014-194015 | A | 10/2014 |
| KR | 20-1997-0055995 | U | 10/1997 |
| KR | 10-2005-0094548 | A | 9/2005 |
| KR | 10-2009-0041082 | A | 4/2009 |
| KR | 10-1223938 | B1 | 1/2013 |
| KR | 101223938 | B1 * | 1/2013 |
| KR | 10-2013-0042863 | A | 4/2013 |
| KR | 10-1376258 | B1 | 3/2014 |
| KR | 10-2016-0002919 | A | 1/2016 |
| WO | WO 2007/132808 | A1 | 11/2007 |

OTHER PUBLICATIONS

Extended European Search Report dated Jul. 8, 2019 for Application No. 17886254.6.

* cited by examiner

[Figure 2]
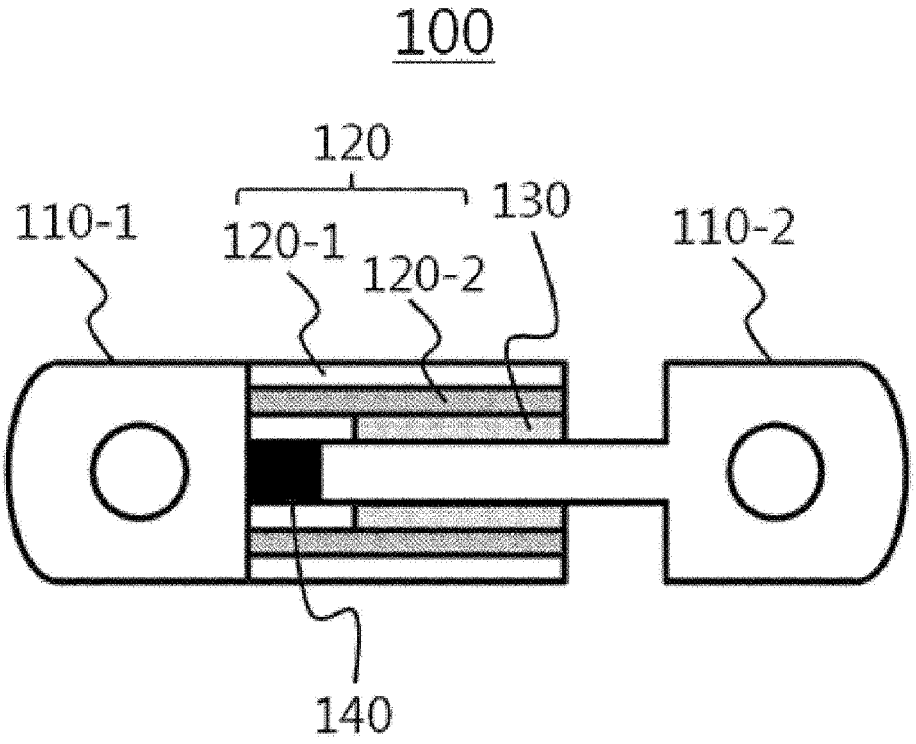

[Figure 3]
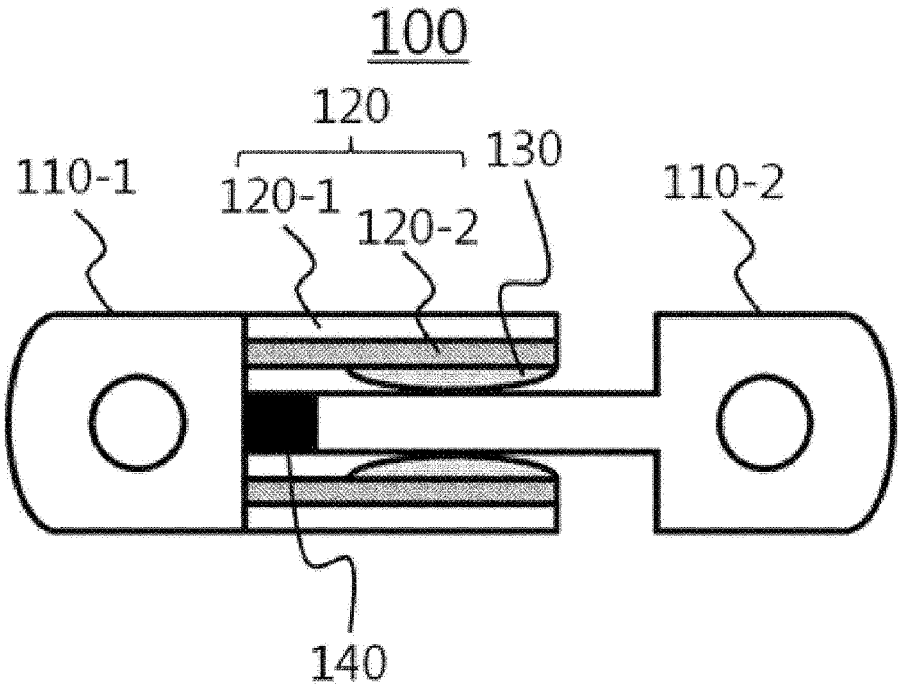

[Figure 4]
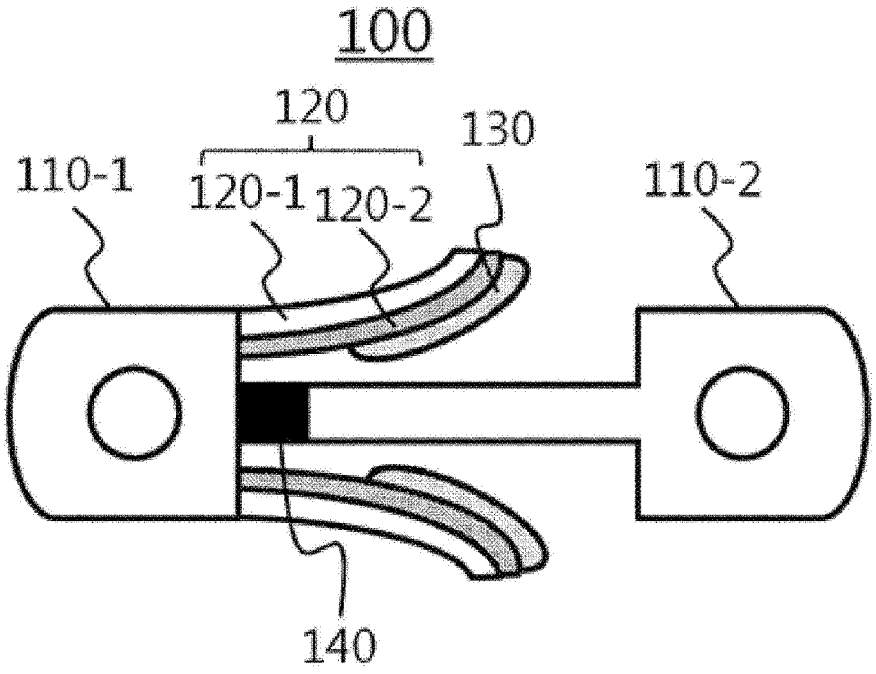

RECYCLABLE FUSE CAPABLE OF REUSE

TECHNICAL FIELD

This application claims priority to and the benefit of Korean Patent Application No. 10-2016-0181540 filed in the Korean Intellectual Property Office on Dec. 28, 2016, the entire contents of which are incorporated herein by reference.

The present invention relates to a recyclable fuse, and to a recyclable fuse which electrically connects a first contact and a second contact with each other to allow current to flow when a temperature of the recyclable fuse is less than a predetermined first temperature, electrically interrupts the first contact and the second contact from each other to prevent the current from flowing when the temperature is equal to or more than the predetermined first temperature, and electrically interrupts the first contact and the second contact from each other and thereafter, electrically connects the first contact and the second contact to each other again when the temperature is recovered to the temperature less than the predetermined first temperature to recycle a fuse twice or more and reduce maintenance personnel and cost due to replacement of the fuse.

BACKGROUND ART

A fuse, which is one of electronic components, is a device that automatically cuts off excessive currents of a specified value or more in a wire to prevent the excessive currents from continuously flowing. When overcurrent flows, the fuse is melted and cut off due to heat generated by current.

The fuse serves as a circuit breaker that protects electrical or electronic equipment and wiring and mainly uses lead and tin or an alloy of zinc and tin which have a low melting point as materials. However, in the case of tungsten which has a very high melting point, a threadlike thin tungsten wire is made through precision machining to be used as a fuse for micro current.

FIG. 1 is a diagram illustrating a fuse in the related art.

Referring to FIG. 1, the fuse 10 in the related art is configured to include contacts 11-1 and 11-2 and a coil 12. When the overcurrent flows on the fuse 10, the fuse 10 is heated and when the coil 12 melts by heat, electrical connection between the contacts 11-1 and 11-2 is interrupted.

As described above, the fuse 10 in the related art can not be recycled because the coil 12 melts once the electrical connection is cut off and the fuse 10 needs to be particularly replaced with a new fuse. Since such a replacement operation is performed by hand, maintenance personnel is required and labor cost, material cost, and the like are required for every replacement. In addition, such a replacement operation takes one to two days, which makes it impossible to use a circuit including the corresponding fuse during the replacement operation.

DETAILED DESCRIPTION OF THE INVENTION

Technical Problem

An object of the present invention is to provide a recyclable fuse which electrically connects a first contact and a second contact with each other to allow current to flow when a temperature is less than a predetermined first temperature, electrically interrupts the first contact and the second contact from each other to prevent the current from flowing when the temperature is equal to or more than the predetermined first temperature, and electrically interrupts the first contact and the second contact from each other and thereafter, electrically connects the first contact and the second contact to each other again when the temperature is recovered to the temperature less than the predetermined first temperature to recycle a fuse twice or more and reduce maintenance personnel and cost due to replacement of the fuse.

Technical Solution

According to an embodiment of the present invention, a recyclable fuse may include: a first contact and a second contact in which current flows when the first contact and the second contact are electrically connected with each other; and a current control unit allowing the current to flow by electrically connecting the first contact and the second contact with each other when a temperature of the current control unit is less than a predetermined first temperature and preventing the current from flowing by electrically interrupting the first contact and the second contact from each other when the temperature of the current control unit is equal to or more than the predetermined first temperature, and the current control unit may electrically interrupt the first contact and the second contact and thereafter, when the temperature of the current control unit is recovered to a temperature less than the predetermined first temperature, the current control unit may electrically connect the first contact and the second contact to each other again.

The current control unit may be formed by two or more metals having different thermal expansion coefficients and the current control unit may be bent toward a metal having a low thermal expansion coefficient when the temperature of the current control unit is equal to or more than the predetermined first temperature and contact between the first contact and the current control unit may be separated to electrically interrupt the first contact and the second contact.

The recyclable fuse may further include a bonding portion which is formed at a contact point between the first contact and the current control unit and which is in a solidified state showing a bonding property such that the contact between the first contact and the second contact is maintained when the temperature of the current control unit is less than the predetermined second temperature, which is in a softened state showing viscoelasticity such that the contact between the first contact and the second contact is separated when the temperature of the current control unit is equal to or more than the predetermined second temperature, and which is in the solidified state again when the temperature of the current control unit is recovered to a temperature less than the predetermined second temperature after the bonding portion is in the softened state showing the viscoelasticity.

The bonding portion may include a material having electrical conductivity.

The bonding portion may include a vinyl acetate-based adhesive.

The predetermined first temperature may be higher than the predetermined second temperature.

The recyclable fuse may further include an insulating unit provided between the first contact and the second contact.

The current control unit may be formed in a part of the first contact.

A plurality of current control units may be provided.

Advantageous Effects

According to an aspect of the present invention, it is possible to provide a recyclable fuse which electrically connects a first contact and a second contact with each other to allow current to flow when a temperature of the recyclable fuse is less than a predetermined first temperature, electrically interrupts the first contact and the second contact from each other to prevent the current from flowing when the temperature is equal to or more than the predetermined first temperature, and electrically interrupts the first contact and the second contact from each other and thereafter, electrically connects the first contact and the second contact to each other again when the temperature is recovered to the temperature less than the predetermined first temperature to recycle a fuse twice or more and reduce maintenance personnel and cost due to replacement of the fuse.

BRIEF DESCRIPTION OF DRAWINGS

FIG. 2 is a diagram illustrating a recyclable fuse according to an embodiment of the present invention.

FIG. 3 is a diagram illustrating a case where a bonding portion of the recyclable fuse according to the embodiment of the present invention melts and is softened.

FIG. 4 is a diagram illustrating a case where a current control unit of the recyclable fuse according to the embodiment of the present invention is bent to electrically interrupt a first contact and a second contact from each other.

BEST MODE

Figure 1:
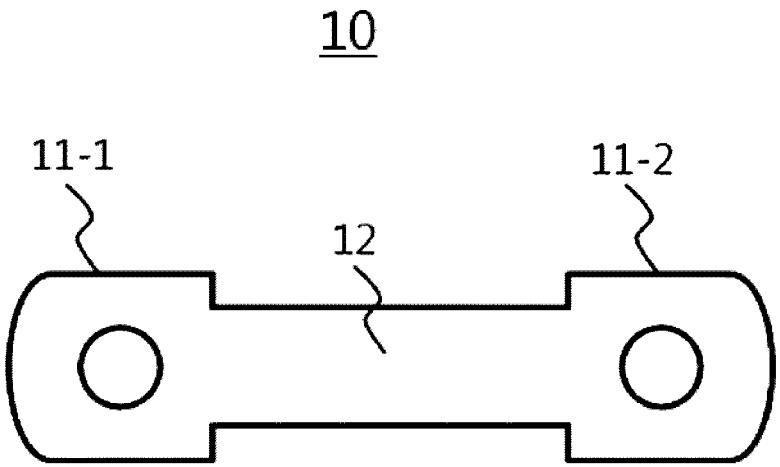
Figure 1 Prior Art
FIG. 1 is a diagram illustrating a fuse in the related art.

The present invention will be described below in detail with reference to the accompanying drawings. Herein, the repeated description and the detailed description of publicly-known function and configuration that may make the gist of the present invention unnecessarily ambiguous will be omitted. Embodiments of the present invention are provided for more completely describing the present invention to those skilled in the art. Accordingly, shapes, sizes, and the like of elements in the drawings may be exaggerated for clearer explanation.

Throughout the specification, unless explicitly described to the contrary, a case where any part "includes" any component will be understood to imply the inclusion of stated components but not the exclusion of any other component.

In addition, the term "unit" disclosed in the specification means a unit that processes at least one function or operation, and the unit may be implemented by hardware or software or a combination of hardware and software.

Hereinafter, referring to FIGS. 2 to 4, a configuration of a recyclable fuse 100 according to an embodiment of the present invention will be described and an example in which the recyclable fuse 100 is electrically interrupted and then recovered to be electrically connected again will be described.

FIG. 2 is a diagram illustrating a recyclable fuse according to an embodiment of the present invention, FIG. 3 is a diagram illustrating a case where a bonding portion of the recyclable fuse according to the embodiment of the present invention melts and is softened, and FIG. 4 is a diagram illustrating a case where a current control unit of the recyclable fuse according to the embodiment of the present invention is bent to electrically interrupt a first contact and a second contact from each other.

Referring to FIGS. 2 to 4, the recyclable fuse 100 according to the embodiment of the present invention is configured to include a first contact 110-1, a second contact 110-2, a current control unit 120, a bonding portion 130, and an insulating unit 140. The recyclable fuse 100 illustrated in FIG. 2 follows the embodiment and constituent elements illustrated in FIG. 2 are not limited to the embodiment illustrated in FIG. 2 and as necessary, the constituent elements may be added, modified, or deleted.

When the first contact 110-1 and the second contact 110-2 are electrically connected to each other, current flows. The first contact portion 110-1 and the second contact portion 110-2 are formed with screw holes to be fixed to a desired circuit through screws and when the first and second contacts 110-1 and 110-2 need to be replaced, the first and second contacts 110-1 and 110-2 may be easily replaced.

The current control unit 120 electrically connects the first contact 110-1 and the second contact 110-2 to each other to allow the current to flow when a temperature is less than a predetermined first temperature and electrically interrupts the first contact 110-1 and the second contact 110-2 from each other to prevent the current from flowing when the predetermined temperature is equal to or more than the predetermined first temperature. In addition, the current control unit 120 electrically interrupts the first contact 110-1 and the second contact 110-2 from each other and thereafter, electrically connects the first contact 110-1 and the second contact 110-2 to each other again when the temperature is recovered to the temperature less than the predetermined first temperature.

In the embodiment, the current control unit 120 is formed by two or more metals 120-1 and 120-2 having different thermal expansion coefficients, and when the temperature is equal to or more than the predetermined first temperature, the current control unit 120 is bent to the metal 120-1 having a low thermal expansion coefficient to separate contact between the first contact 110-1 and the second contact 110-2, thereby electrically interrupting the first contact 110-1 and the second contact 110-2. That is, when the metal 120-1 of the metals 120-1 and 120-2 constituting the current control unit 120 has a thermal expansion coefficient lower than the metal 120-2 and when the current control unit 120 is heated by the overcurrent, the current control unit 120 is bent toward the metal 120-1 because the metal 120-2 is gradually expanded more than the metal 120-1 as the temperature rises. FIG. 4 illustrates a case when the current control unit 120 is bent toward the metal 120-1 having the low thermal expansion coefficient and the contact between the first contact 110-1 and the second contact 110-2 is separated to electrically interrupt the first contact 110-1 and the second contact 110-2. The predetermined first temperature is a temperature at when the first control unit 120 is bent toward the metal 120-1 having the low thermal expansion coefficient and the first contact 110-1 and the second contact 110-2 are electrically interrupted and a producer or a user changes a combination of the metals 120-1 and 120-2 used in the current control unit 120 as necessary to set the predetermined first temperature.

In the embodiment, the current control unit 120 may be formed in a part of the first contact 110-1 as illustrated in FIGS. 2 to 4. When the temperature is lower than the predetermined first temperature, the current control unit 120 contacts the second contact 110-2 and when the temperature is equal to or higher than the predetermined first temperature, the current control unit 120 is bent toward the metal 120-1 having the low thermal expansion coefficient and is separated from the second contact 110-2.

In the embodiment, a plurality of current control units 120 may be provided. In FIGS. 2 to 4, an example in which two current control units 120 are provided is illustrated, but three or more current control units 120 may be provided as needed. Since the recyclable fuse 100 according to the embodiment of the present invention is configured such that the current is cut off when the contact of the current control unit 120 is completely disconnected, when the number of current control units 120 increases, the current may be cut off more carefully.

The bonding portion 130 is formed at a contact point between the first contact 110-1 and the current control unit 120 and is in a solidified state showing a bonding property such that the contact between the first contact 110-1 and the current control unit 120 may be maintained when the temperature of the current control unit 120 is less than the predetermined second temperature, is in a softened state showing viscoelasticity so that the contact between the first contact portion 110-1 and the current control unit 120 is separated when the temperature is equal to or more than the predetermined second temperature, and is in the solidified state again when temperature is recovered to a temperature less than the predetermined second temperature after the bonding portion 130 is in the softened state showing the viscoelasticity. FIG. 3 illustrates a case where the temperature of the current control unit 120 is equal to or more than the predetermined second temperature and the bonding portion 130 is in the softened state showing the viscoelasticity. The predetermined second temperature is a temperature when the bonding portion 130 is heated and is in the softened state as the temperature rises and the producer or the user changes a combination of materials used for the bonding portion 130 as necessary to set the predetermined second temperature. As described above, as a material that is in the solidified state showing a bonding property at a room temperature and is softened to be in the softened state having the viscoelasticity by losing the bonding property when the temperature becomes a high temperature of 40° C. or more as heat is applied, there is a vinyl acetate-based adhesive and the material may be included in the bonding portion 130.

In the embodiment, the predetermined first temperature is higher than the predetermined second temperature. Accordingly, when the recyclable fuse 100 according to the embodiment of the present invention is heated, the recycle fuse 100 first reaches the predetermined second temperature and the bonding portion 130 is softened to deteriorate the bonding property and then, the current control unit 120 may be bent by reaching the predetermined first temperature.

In the embodiment, the bonding portion 130 may include a material having electrical conductivity. As described above, as the bonding portion 130 includes the material having the electrical conductivity, when the bonding portion 130 maintains the contact between the first contact 110-1 and the current control unit 120 in the solidified state showing the bonding property, the current may flow between the first contact 110-1 and the second contact 110-2.

The insulating unit 140 is provided between the first contact 110-1 and the second contact 110-2. When the contact between the first contact 110-1 and the current control unit 120 is disconnected, the insulating unit 140 serves to interrupt the first contact 110-1 and the second contact 110-2 from each other so as to prevent the current from flowing between the first contact 110-1 and the second contact 110-2.

Referring back to FIGS. 2 to 4, a process in which the recyclable fuse 100 according to the embodiment of the present invention is electrically interrupted and then, is restored to be electrically connected will be summarized and described.

First, as illustrated in FIG. 2, in the recyclable fuse 100, the contact between the first contact 110-1 and the current control unit 120 is maintained at the room temperature, and as a result, the current may flow between the first contact 110-1 and the second contact 110-2.

In addition, when the overcurrent flows, the recyclable fuse 100 reaches the predetermined second temperature and the bonding portion 130 becomes the softened state showing the viscoelasticity as illustrated in FIG. 3.

Then, when the recyclable fuse 100 reaches the predetermined first temperature, the current control unit 120 is bent toward the metal 120-1 having the low thermal expansion coefficient and the contact between the first contact 110-1 and the second contact 110-2 is separated to electrically interrupt the first contact 110-1 and the second contact 110-2 as illustrated in FIG. 4.

When the temperature of the recyclable fuse 100 drops to a temperature less than the predetermined first temperature after a period of time after the interruption, the current control unit 120 is restored to an original state as illustrated in FIG. 3 from a bent state.

In addition, when the temperature of the recyclable fuse 100 drops to a temperature less than the predetermined second temperature, the bonding portion 130 is restored to the solidified state showing the bonding property again as illustrated in FIG. 2, so that the contact between the first contact portion 110-1 and the second contact portion 110-2 may be maintained.

Since the recyclable fuse 100 according to the embodiment of the present invention is restored to the original state again after the interruption through the process, it is possible to recycle the recyclable fuse 100 two times or more and to reduce maintenance personnel and cost due to the replacement of the fuse.

Hereinabove, a specific embodiment of the present invention has been illustrated and described, but the technical spirit of the present invention is not limited to the accompanying drawings and the described contents and it is apparent to those skilled in the art that various modifications of the present invention can be made within the scope without departing from the spirit of the present invention and it will be regarded that the modifications are included in the claims of the present invention without departing from the spirit of the present invention.

The invention claimed is:

1. A recyclable fuse comprising:

a first contact and a second contact, wherein current flows through the first contact and the second contact when the first contact and the second contact are electrically connected with each other;

a current control unit configured to:

control the flow of the current by electrically connecting the first contact and the second contact with each other when a temperature of the current control unit is less than a predetermined first temperature, prevent the current from flowing by electrically interrupting the first contact and the second contact from each other when the temperature of the current control unit is equal to or more than the predetermined first temperature, and electrically connect the first contact and the second contact to each other again when the temperature of the current control unit is recovered to a temperature less than the predetermined first temperature; and a bonding portion provided at a contact point between the first contact and the current control unit, wherein the bonding portion is in a solidified state to maintain the contact between the first contact and the second contact when the temperature of the current control unit is less than a predetermined second temperature, and wherein the bonding portion is in a softened state when the temperature of the current control unit is equal to or more than the predetermined second temperature, and is re-solidified when the temperature of the current control unit is recovered to a temperature less than the predetermined second temperature after the bonding portion is in the softened state.

2. The recyclable fuse of claim 1, wherein the current control unit comprises two or more metals having different thermal expansion coefficients, and wherein the current control unit is configured to be bent toward a metal of the two or more metals having a lower thermal expansion coefficient than another metal of the two or more metals when the temperature of the current control unit is equal to or more than the predetermined first temperature to separate contact between the first contact and the current control unit and to electrically interrupt the first contact and the second contact.

3. The recyclable fuse of claim 1, wherein the bonding portion includes a material having electrical conductivity.

4. The recyclable fuse of claim 1, wherein the bonding portion includes a vinyl acetate-based adhesive.

5. The recyclable fuse of claim 1, wherein the predetermined first temperature is higher than the predetermined second temperature.

6. The recyclable fuse of claim 1, further comprising:

an insulating unit provided between the first contact and the second contact.

7. The recyclable fuse of claim 1, wherein the current control unit is formed in a part of the first contact.

8. The recyclable fuse of claim 1, wherein a plurality of current control units is provided.

* * * * *